US010446121B1

(12) United States Patent
Taguchi

(10) Patent No.: US 10,446,121 B1
(45) Date of Patent: Oct. 15, 2019

(54) ACTION OF GRAND PIANO

(71) Applicant: KABUSHIKI KAISHA KAWAI GAKKI SEISAKUSHO, Hamamatsu-shi, Shizuoka-ken (JP)

(72) Inventor: Takaaki Taguchi, Hamamatsu (JP)

(73) Assignee: KABUSHIKI KAISHA KAWAI GAKKI SEISA KUSHO, Hamamatsu-Shi, Shuzuoka-Ken (JP)

( * ) Notice: Subject to any disclaimer, the term of this patent is extended or adjusted under 35 U.S.C. 154(b) by 0 days.

(21) Appl. No.: 16/366,915

(22) Filed: Mar. 27, 2019

(30) Foreign Application Priority Data

Mar. 28, 2018 (JP) ..... 2018-061287

(51) Int. Cl.
*G10C 3/22* (2019.01)

(52) U.S. Cl.
CPC ..... *G10C 3/22* (2013.01)

(58) Field of Classification Search
CPC ..... G10C 3/22; G10C 3/20
See application file for complete search history.

(56) References Cited

U.S. PATENT DOCUMENTS

2005/0284279 A1* 12/2005 Wroblewski ..... G10C 3/22 84/239

FOREIGN PATENT DOCUMENTS

JP 4851033 1/2012

* cited by examiner

*Primary Examiner* — Kimberly R Lockett
(74) *Attorney, Agent, or Firm* — Lewis Roca Rothgerber Christie LLP

(57) ABSTRACT

An action of a grand piano, which makes it possible to reduce not only the weight of a jack, but also that of a wippen, to thereby improve string striking repeatability. The action includes a wippen of a synthetic resin configured to pivotally move upward by being pushed up by the depressed key, a jack pivotally mounted to the wippen, for pushing up the hammer in accordance with pivotal motion of the wippen to cause the hammer to pivotally move upward, and a jack angular position-adjusting mechanism provided on the wippen to adjust an angular position of the jack. The mechanism has a support portion integrally formed with the wippen, an adjustment screw screwed into the support portion movably in a front-rear direction, and a jack button provided on an end of the adjustment screw for defining the angular position of the jack by abutment therewith.

4 Claims, 3 Drawing Sheets

ACTION OF GRAND PIANO

CROSS-REFERENCE TO RELATED APPLICATION(S)

This application claims priority to Japanese Patent Application Number 061287/2018, filed on Mar. 28, 2018, the entire contents of which are incorporated herein by reference.

BACKGROUND OF THE INVENTION

Field of the Invention

The present invention relates to an action of a grand piano, which operates in accordance with depression of a key to thereby cause pivotal motion of a hammer, and more particularly to a structure for adjusting an angular position of a jack pivotally supported by a wippen.

Description of the Related Art

In general, an action of a grand piano includes a wippen placed on a rear portion of a key extending in a front-rear direction, a repetition lever and a jack each pivotally mounted to the wippen, and a repetition spring for urging these in a returning direction. The wippen is comprised of a body portion extending in the front-rear direction, a lever flange portion extending upward from a central portion of the body portion, a heel portion protruding downward from the central portion of the body portion, and so forth. The repetition lever extends in the front-rear direction and has its central portion pivotally supported by an upper end of the lever flange portion of the wippen. Further, the repetition lever has a front end thereof formed with a jack guide hole vertically extending therethrough. The jack has an L shape formed by a base portion, a hammer push-up portion extending upward from the base portion, and a regulating button abutment portion extending forward from the base portion. The base portion of the jack is pivotally supported by a front end of the wippen.

Further, a hammer is comprised of a hammer shank extending in the front-rear direction and a hammer head integrally formed on a rear end of the hammer shank. The hammer shank has a front end thereof pivotally supported by a hammer shank flange, and a shank roller is provided on the lower surface of the hammer shank at a location immediately rearward of the front end. In a key-released state, the shank roller is positioned on the rim of the jack guide hole of the repetition lever, and a tip end of the hammer push-up portion of the jack is positioned immediately under the shank roller.

The action constructed as above is generally provided with an adjustment mechanism that adjust an angular position of the jack operated in accordance with depression of the key, for efficient transmission of a force generated by key depression from the jack to the hammer. Specifically, the adjustment mechanism is comprised of a jack button screw screwed through the central portion of the hammer push-up portion of the jack in the front-rear direction, a jack button mounted on a rear end of the jack button screw, and a spoon which is erected on the upper surface of the body portion of the wippen and with which the jack button is in abutment. In the adjustment mechanism, by turning the jack button screw, the jack button integrally mounted to the jack button screw is moved forward and rearward in the front-rear direction, whereby the distance between the jack and the spoon with which the jack button is in abutment is changed. This adjusts the angular position of the jack in the key-released state.

In the above-described action, however, since the jack button screw and the jack button of the adjustment mechanism are attached to the jack, the weight of the entire jack is increased, which inevitably increases an inertial force generated by pivotal motion of the jack. For this reason, there is a certain limit to reduction of time which the jack takes to return to its original position after having pushed up the hammer. As a consequence, it is sometimes impossible to provide sufficient string striking repeatability when the same key is repeatedly depressed. To solve this problem, an action which makes it possible to reduce the weight of a jack has been proposed e.g. in Japanese Patent No. 4851033.

In the action disclosed in Japanese Patent No. 4851033, an adjustment mechanism for adjusting an angular position of a jack is provided only in a wippen. Specifically, the adjustment mechanism includes a stop screw which is erected at a predetermined location on a front portion of the wippen and is formed by a metal rod having an upper end thereof bent toward the jack, a stop button mounted to a tip end of the stop screw in a screwed state, and a button felt for shock absorption which is bonded to a jack side of the stop button and with which the jack is in abutment. A position where the jack is in abutment with the button felt is adjusted by moving the stop button in the front-rear direction through turning thereof, whereby the angular position of the jack is adjusted.

In the above-described action, the whole of the adjustment mechanism for adjusting the angular position of the jack is provided on the wippen, whereas the jack is not provided with any component of the adjustment mechanism. Therefore, the action makes it possible to reduce the weight of the jack compared with the conventional action described hereinbefore. However, in the above-described action, as the adjustment mechanism, the stop screw formed by the metal rod is erected on the front portion of the wippen, and when the jack comes into abutment with the button felt after having pushed up the hammer, a relatively large load is applied to the stop screw, so that it is required that the stop screw has a sufficient strength to securely receive the load. However, if a material having a high strength is used for the stop screw, the weight of the stop screw itself is increased, resulting in an increase in the weight of the entire wippen. In this case, the inertial force generated by pivotal motion of the wippen is increased, and therefore, there is a fear that sufficient string striking repeatability cannot be obtained similar to a case where the weight of the jack is heavy.

SUMMARY OF THE INVENTION

It is an object of the present invention to provide an action of a grand piano, which makes it possible to reduce not only the weight of a jack, but also that of a wippen, to thereby improve string striking repeatability.

To attain the above object, the present invention provides action of a grand piano, which operates in accordance with depression of a key to thereby cause pivotal motion of a hammer, including a wippen formed by a molded article of a synthetic resin and configured to pivotally move upward by being pushed up by the key subjected to key depression, a jack pivotally mounted to the wippen and configured to push up the hammer in accordance with pivotal motion of the wippen to cause the hammer to pivotally move upward, and a jack angular position-adjusting mechanism provided on the wippen so as to adjust an angular position of the jack, wherein the jack angular position-adjusting mechanism has a support portion integrally formed with the wippen, an adjustment screw extending a predetermined length in a front-rear direction and screwed into the support portion such that the adjustment screw is movable forward and backward in the front-rear direction, and an abutment portion provided on a jack-side end of the adjustment screw, for defining the angular position of the jack by abutment with the jack.

According to this arrangement, the wippen is formed by a molded article of a synthetic resin, the jack is pivotally mounted to the wippen, and the jack angular position-adjusting mechanism is provided on the wippen. In other words, the adjustment mechanism for adjusting the angular position of the jack is not provided on the jack itself, and hence it is possible to maintain a reduced weight of the jack. Further, in the jack angular position-adjusting mechanism provided on the wippen, by turning the adjustment screw screwed into the support portion, the abutment portion provided on the jack-side end of the adjustment screw is moved forward and backward in the front-rear direction in unison with the adjustment screw, whereby the angular position of the jack in abutment with the abutment portion can be adjusted with ease. In the above-described jack angular position-adjusting mechanism, the support portion into which the adjustment screw is screwed is integrally formed with the wippen, and hence the present adjustment mechanism makes it possible to further reduce the weight of the entire wippen compared with the conventional one in which a stop screw formed by a metal rod is erected on the wippen. As described above, according to the present invention, it is possible to reduce not only the weight of the jack, but also that of the wippen, and thereby improve string striking repeatability.

Preferably, the wippen has a lever flange portion extending upward a predetermined length and pivotally supporting a repetition lever on which the hammer is placed, by an upper end thereof, and the support portion includes a pair of extension portions extending in parallel with each other from the lever flange portion of the wippen toward the jack, and an adjustment screw-engaging portion provided on tip ends of the pair of extension portions and having a screw hole formed therethrough through which the adjustment screw is screwed in a state extending between the pair of extension portions substantially along a direction of a length thereof.

According to the arrangement of this preferred embodiment, the wippen has the lever flange portion extending upward the predetermined length, and the repetition lever on which the hammer is placed is pivotally supported by the upper end of the lever flange portion. Further, the support portion of the jack angular position-adjusting mechanism has the pair of extension portions extending in parallel with each other from the lever flange portion toward the jack and the adjustment screw-engaging portion provided on the tip ends of the extension portions. The adjustment screw-engaging portion is formed with the screw hole through which the adjustment screw is screwed in a state extending between the pair of extension portions substantially along the direction of the length of the extension portions. This makes it possible, when the jack having pushed up the hammer comes into abutment with the abutment portion provided on the end of the adjustment screw, to securely receive a load from the jack by the lever flange portion, which has a relatively sturdy construction, via the adjustment screw and the pair of extension portions extending substantially linearly in parallel with each other. Therefore, by constructing the support portion of the jack angular position-adjusting mechanism as described above, it possible to obtain the jack angular position-adjusting mechanism which meets both of the requirements of improvement of strength and weight reduction.

Preferably, the abutment portion is mounted to the adjustment screw in a state in which the jack-side end of the adjustment screw faces outside, and a portion, with which the abutment portion comes into abutment, of the jack is formed with an operation hole through which a predetermined tool can be inserted from a front side so as to turn the end of the adjustment screw.

According to the arrangement of this preferred embodiment, the abutment portion is mounted to a jack-side end of the adjustment screw in a state in which the jack-side end faces outside. Further, the portion of the jack with which the abutment portion comes into abutment is formed with the operation hole through which the predetermined tool can be inserted from the front side. Therefore, it is possible to insert the tool through the operation hole from the front side and turn the end of the adjustment screw. In other words, the adjustment screw can be turned with the tool engaged with the end of the adjustment screw. Thus, the adjustment screw can be turned from the front side of the jack using the tool, and hence it is possible to adjust the angular position of the jack with ease by turning the adjustment screw.

The above and other objects, features, and advantages of the present invention will become more apparent from the following detailed description taken in conjunction with the accompanying drawings.

BRIEF DESCRIPTION OF THE DRAWINGS

FIGS. 4A and 4B are views useful in explaining adjustment of the jack, which is performed by turning the adjustment screw, in which FIG. 4A shows a state before the adjustment, and FIG. 4B shows a state after the adjustment.

DETAILED DESCRIPTION OF PREFERRED EMBODIMENTS

Figure 1A:
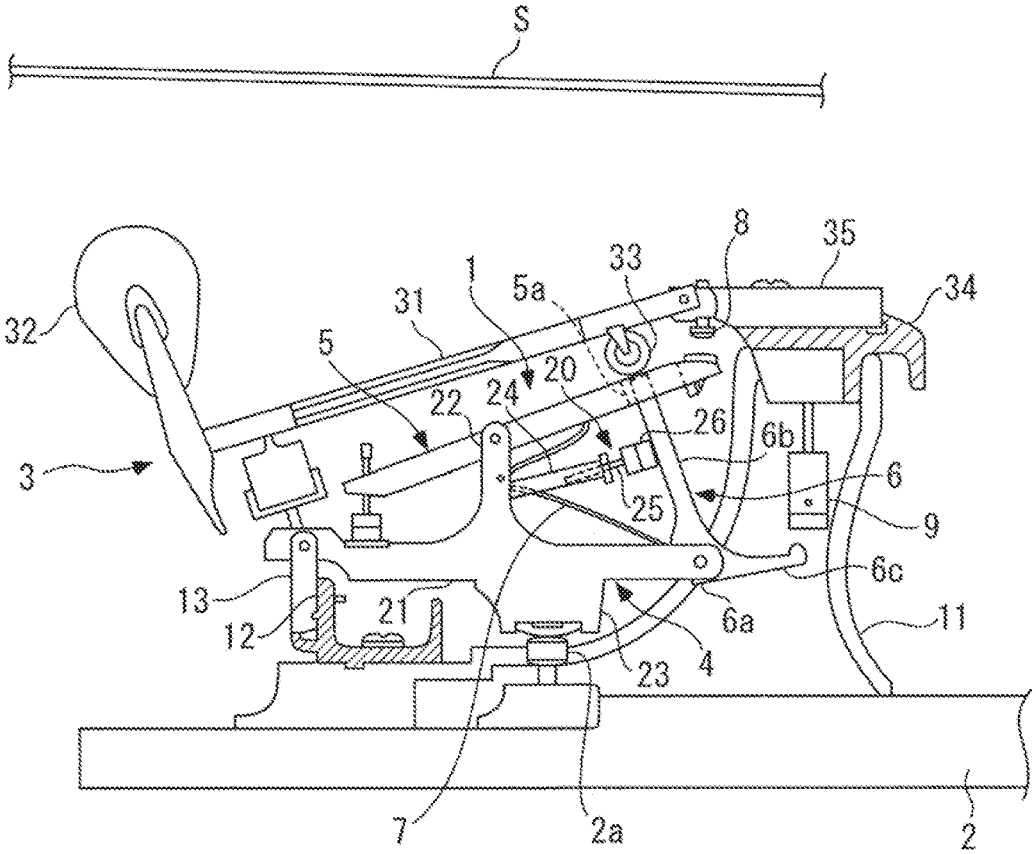
FIG. 1A is a side view of a keyboard device including an action of a grand piano, according to an embodiment of the present invention.

The present invention will now be described in detail with reference to the drawings showing preferred embodiments thereof. FIG. 1A shows an action of a grand piano, according to an embodiment of the present invention. The action 1 operates in accordance with depression of a key 2 to cause a hammer 3 to pivotally move upward, and when the hammer 3 strikes a string S, a piano tone is generated.

As shown in FIG. 1A, the action 1 is disposed rearward (leftward as viewed in FIG. 1A) of a pivot (not shown) of the key 2 extending in the front-rear direction (left-right direction as viewed in FIG. 1A) and above the key 2, and is comprised of a wippen 4 pivotally movable about a rear end (left end as viewed in FIG. 1A) thereof, a repetition lever 5 and a jack 6 each pivotally attached to the wippen 4, and a repetition spring 7 for urging the two component parts 5 and 6 in a returning direction (counterclockwise direction as viewed in FIG. 1A). Further, a drop screw 8 and a regulating button 9 for restricting upward movements of the respective repetition lever 5 and the jack 6 are provided on an action-by-action basis.

The action 1 is disposed between brackets 11 and (only one of which is shown in FIG. 1A) provided respectively at left and right ends of a keyframe (not shown) on which the key 2 is placed. Between the left and right brackets 11 and 11, a wippen rail 12 extends in the left-right direction, and the rear end of the wippen 4 is pivotally mounted to a wippen flange 13 fastened to the wippen rail 12 with a screw.

The wippen 4 is formed by a molded article of a synthetic resin, such as an ABS resin, which is excellent in impact resistance. The wippen 4 includes a body portion 21 extending in the front-rear direction, a lever flange portion 22 extending upward a predetermined length from a central portion of the body portion 21, a heel portion 23 protruding downward from the central portion of the body portion 21, and a support portion 24 for supporting a jack button 26 of a jack angular position-adjusting mechanism 20, described hereinafter. The wippen 4 is placed on a capstan screw 2*a* of the key 2 via the heel portion 23. Further, in the wippen 4, a front end portion of the body portion 21 and an upper half portion of the lever flange portion 22 are each formed in a bifurcated shape having left and right prongs.

The repetition lever 5 extends obliquely forward and upward in the front-rear direction and has a central portion thereof pivotally mounted inside upper ends of the lever flange portion 22 of the wippen 4. At a predetermined location in a front portion of the repetition lever 5, there is formed a jack guide hole 5*a* vertically extending therethrough and extending a predetermined length in the front-rear direction.

The jack 6 has an L shape, in side view, which is formed by a base portion 6*a*, a hammer push-up portion 6*b* extending upward from the base portion 6*a*, and a regulating button abutment portion 6*c* extending forward from the base portion 6*a*, and has its base portion 6*a* pivotally mounted inside front ends of the body portion 21 of the wippen 4. An upper end of the hammer push-up portion 6*b* is engaged in the jack guide hole 5*a* of the repetition lever 5 in a state inserted from below such that the upper end is movable in the front-rear direction. In a key-released state, the upper end of the hammer push-up portion 6*b* is opposed to a shank roller 33, referred to hereinafter, of the hammer 3 with a slight space therebetween. Further, the hammer push-up portion 6*b* is formed with an operation hole 6*d* through which a predetermined tool T (see FIG. 4A) can be inserted so as to operate an adjustment screw 25, referred to hereinafter, of the jack angular position-adjusting mechanism 20 from the front side.

Further, the wippen 4 is provided with the jack angular position-adjusting mechanism 20 for adjusting an angular position of the jack 6. The jack angular position-adjusting mechanism 20 is comprised of the support portion 24 integrally formed with the wippen 4, the adjustment screw 25 screwed in the support portion 24 such that the adjustment screw 25 is movable forward and backward in the front-rear direction, and the jack button 26 which is provided at a front end of the adjustment screw 25 and is in abutment with the hammer push-up portion 6*b* of the jack 6.

Figure 1B:
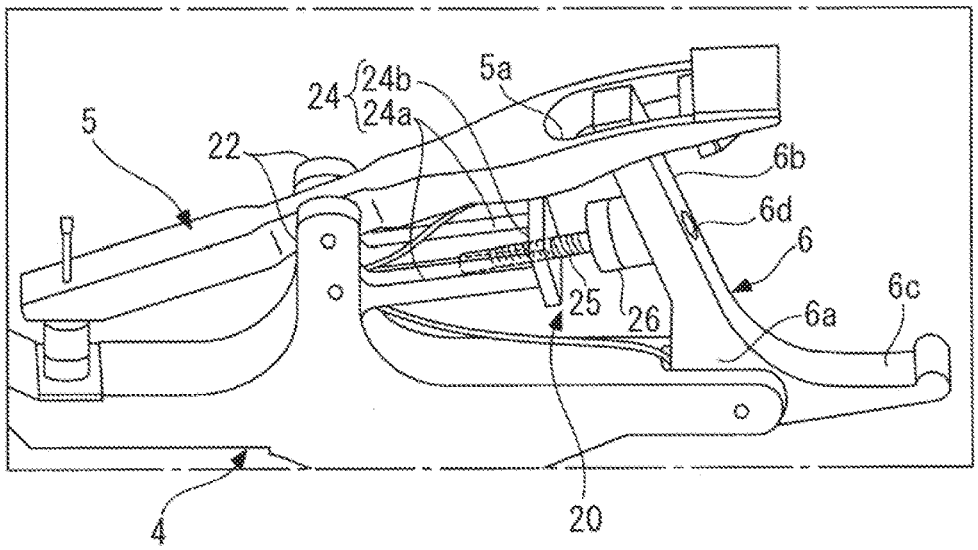
FIG. 1B is an enlarged perspective view of a jack angular position-adjusting mechanism and component parts associated therewith.

As shown in FIG. 1B, the support portion 24 is comprised of a pair of left and right extension portions 24*a* and 24*a* extending a predetermined length in parallel with each other from front surfaces of the respective prongs of the lever flange portion 22 toward the jack 6, and an adjustment screw-engaging portion 24*b* formed in a plate shape having a predetermined thickness and continuous with front ends of the extension portions 24*a* and 24*a*. The adjustment screw-engaging portion 24*b* is formed in a rectangular shape as viewed from the jack side and has a screw hole formed through a central portion thereof.

Figure 2:
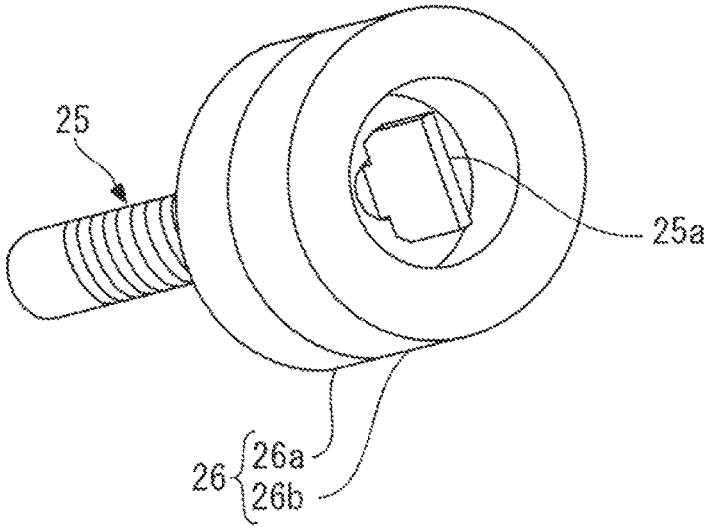
FIG. 2 is a perspective view of a jack button and an adjustment screw.

FIG. 2 shows the adjustment screw 25 and the jack button 26. As shown in FIG. 2, the adjustment screw 25 is formed by a metal rod having a predetermined diameter and a predetermined length, and has a front end thereof formed with an operation portion 25*a* formed in a flat shape. The operation portion 25*a* is operated for turning the adjustment screw 25. Further, the jack button 26 is fixed to the end of the adjustment screw 25 in a state covering the operation portion 25*a*, and a portion of the adjustment screw 25 rearward of the jack button 26 is formed with a male screw that screws into the screw hole of adjustment screw-engaging portion 24*b*.

The jack button 26 is comprised of a button body portion 26*a* mounted to the adjustment screw 25 in a state having the adjustment screw 25 inserted therethrough and a cylindrical cushion portion 26*b* bonded to a front surface of the button body portion 26*a*. The button body portion 26*a* is made of a predetermined synthetic resin (e.g. an ABS resin) and is formed in a cylindrical shape having a predetermined outer diameter and a predetermined length. On the other hand, the cushion portion 26*b* is made of e.g. felt and formed in a thick cylindrical shape. The cushion portion 26*b* has the same outer diameter as that of the button body portion 26*a* and an inner diameter larger than a length of the operation portion 25*a* of the adjustment screw 25 in a diametrical direction.

Figure 3:
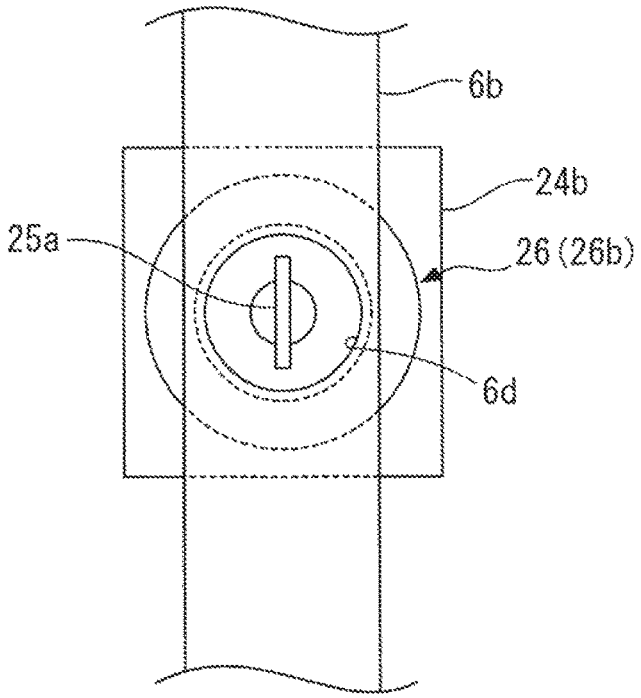
FIG. 3 is an enlarged view of a portion, which is in abutment with the jack, of the jack button, as viewed from the front of the jack.

Further, the cushion portion 26*b* is formed to have an axial length longer than the axial length of the operation portion 25*a* of the adjustment screw 25. Therefore, in a state where the jack button 26 is in abutment with the hammer push-up portion 6*b* of the jack 6, only the cushion portion 26*b* is in contact with the hammer push-up portion 6*b*, and the operation portion 25*a* of the adjustment screw 25 is prevented from being brought into contact with the same. In this case, as shown in FIG. 3, the operation portion 25*a* of the adjustment screw 25 faces forward via the operation hole 6*d* of the hammer push-up portion 6*b*, so that the adjustment screw 25 can be turned using the tool T from the front side of the jack 6, as will be described below.

Figure 4A:
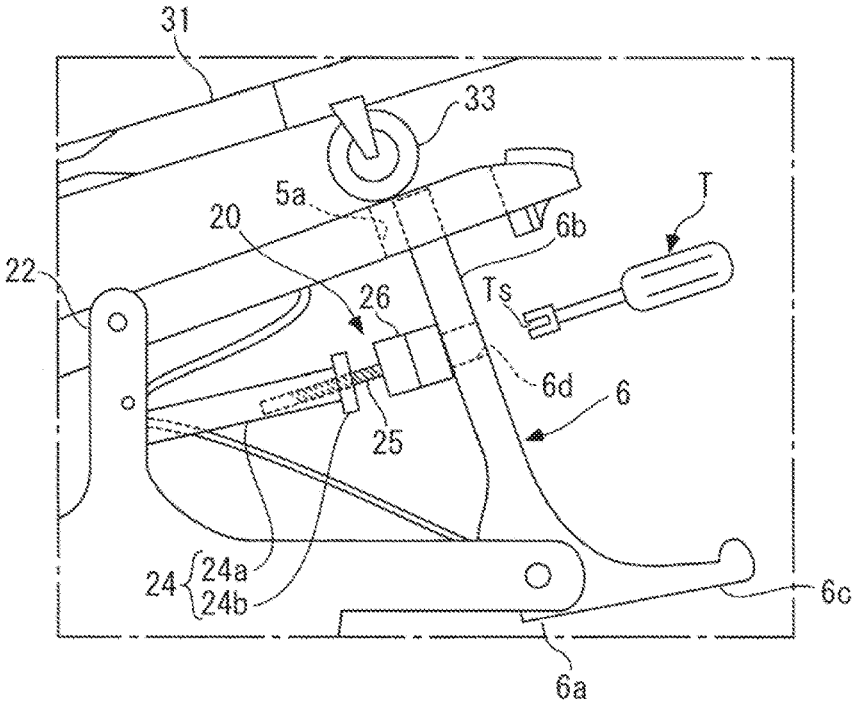

Now, a brief description will be given, with reference to FIGS. 4A and 4B, of how to adjust the angular position of the jack by turning the adjustment screw 25. For this adjustment, for example, the tool T having a slit portion Ts that can be engaged with the operation portion 25*a* of the adjustment screw 25 is used as illustrated in FIG. 4A. First, the slit portion Ts of the tool T is inserted into the operation hole 6*d* from the front of the jack 6 so as to be engaged with the operation portion 25*a* of the adjustment screw 25. Then, the tool T is turned to thereby turn the adjustment screw 25 such that the adjustment screw 25 moves forward or backward in the front-rear direction with respect to the adjustment screw-engaging portion 24*b*.

Figure 4B:
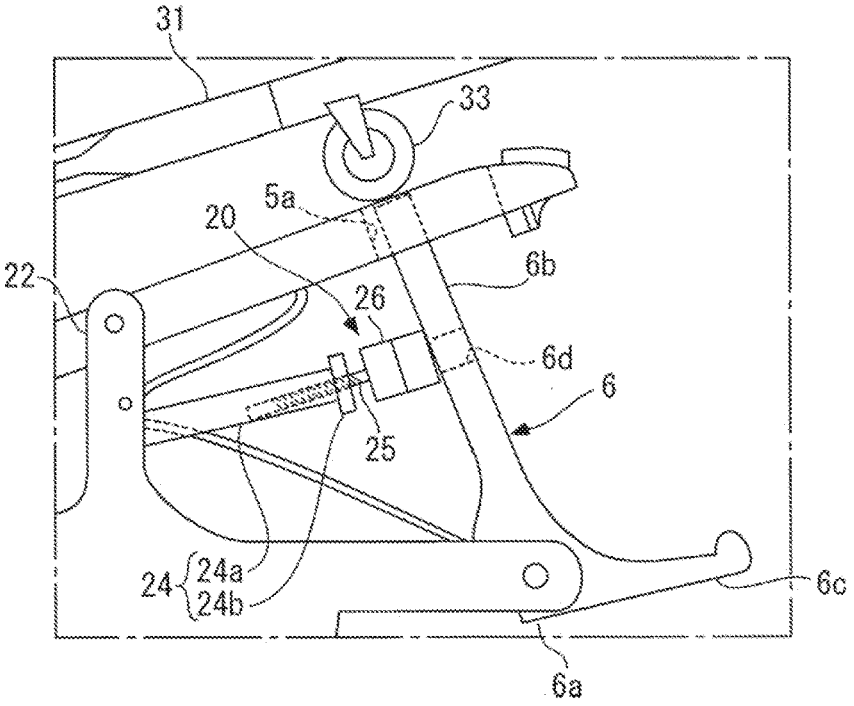

FIG. 4B shows a state where the adjustment screw 25 has been screwed into the adjustment screw-engaging portion 24*b* whereby the jack button 26 has been moved slightly rearward. In this case, the jack 6 has slightly pivotally moved counterclockwise from the FIG. 4A state before the adjustment, whereby the hammer push-up portion 6*b* is adjusted to a position where the same can properly push up the shank roller 33, referred to hereinafter, of the hammer 3.

As shown in FIG. 1A, the hammer 3 includes a hammer shank 31 extending in the front-rear direction, a hammer head 32 mounted to a tip end (rear end) of the hammer shank 31, and the shank roller 33 attached to the hammer shank 31 at a predetermined location in a front portion of the lower surface of the same. The hammer 3 has a base end portion of the hammer shank 31 thereof pivotally mounted to a hammer shank flange 35 fastened to a hammer shank rail 34 with screws. The shank roller 33 has a cylindrical shape formed e.g. by a cloth provided inside and a skin wound around the outer periphery of the cloth, and is placed on the upper surface of the repetition lever 5 at a location close to the jack guide hole 5*a* in a state straddling the jack guide hole 5*a*.

Next, a description will be given, with reference to FIGS. 1A and 1B, of the operation of the action 1 constructed as above. When the key 2 is depressed in the key-released state shown in FIG. 1A, the wippen 4 is pushed up via the capstan screw 2*a* to pivotally move upward, and the repetition lever 5 and the jack 6 also move upward along with the wippen 4. As a consequence of the movement of these, first, the repetition lever 5 pushes up the hammer 3 via the shank roller 33 in a state held in sliding contact with the shank roller 33, to thereby cause the hammer 3 to pivotally move upward. Then, when the repetition lever 5 is brought into abutment with the drop screw 8 from below and has its upward pivotal motion stopped, the jack 6 pushes up the hammer 3 via the shank roller 33. Thereafter, when the hammer 3 is pivotally moved immediately close to a position for striking a string S horizontally stretched above, the jack 6 is brought into abutment with the regulating button 9 via the regulating button abutment portion 6*c* to have its pivotal motion stopped, whereby the jack 6 leaves the shank roller 33. This releases the hammer 3 from connection with the action 1 and the key 2 to strike the string 3 in a free rotation state.

Further, when the key 2 is released after the hammer 3 has struck the string 3, the hammer 3 and the wippen 4 are pivotally returned by their own weights and the repetition lever 5 and the jack 6 are pivotally returned by the spring force of the repetition spring 7, in respective opposite directions to the directions in which they are pivotally moved when the key 2 is depressed. Further, in this case, the jack 6 comes into abutment with the jack button 26 of the jack angular position-adjusting mechanism 20 whereby it returns to the key-released state.

As described above in detail, according to the present embodiment, the jack angular position-adjusting mechanism 20 is provided in the wippen 4, and the jack 6 itself is not provided with an adjustment mechanism for adjusting the angular position of the jack 6, so that it is possible to maintain reduced weight of the jack 6. Further, by turning the adjustment screw 25 screwed in the support portion 24 provided on the wippen 4, the jack button 26 is moved forward or rearward in unison with the adjustment screw 25 in the front-rear direction, whereby the angular position of the jack 6 in abutment with the jack button 26 can be adjusted with ease. Furthermore, in the jack angular position-adjusting mechanism 20, the support portion 24 in which the adjustment screw 25 is screwed is integrally formed with the wippen 4, and hence it is possible to further reduce the weight of the entire wippen 4 compared with the conventional action. As described above, according to the present embodiment, it is possible to reduce not only the weight of jack 6, but also that of the wippen 4, to thereby improve string striking repeatability.

Note that the present invention is not limited to the above-described embodiment, but it can be practiced in various forms. Further, details of the construction of each of the action 1, the wippen 4, the repetition lever 5, the jack 6, and the jack angular position-adjusting mechanism 20 in the embodiment are described only by way of example, and they can be changed, as desired, within the scope of the subject matter of the present invention.

What is claimed is:

1. An action of a grand piano, which operates in accordance with depression of a key to thereby cause pivotal motion of a hammer, including:

a wippen formed by a molded article of a synthetic resin and configured to pivotally move upward by being pushed up by the key subjected to key depression;

a jack pivotally mounted to the wippen and configured to push up the hammer in accordance with pivotal motion of the wippen to cause the hammer to pivotally move upward; and a jack angular position-adjusting mechanism provided on the wippen so as to adjust an angular position of the jack, wherein the jack angular position-adjusting mechanism comprises:

a support portion integrally formed with the wippen;

an adjustment screw extending a predetermined length in a front-rear direction and screwed into the support portion such that the adjustment screw is movable forward and backward in the front-rear direction; and an abutment portion provided on a jack-side end of the adjustment screw, for defining the angular position of the jack by abutment with the jack.

2. The action of a grand piano, according to claim 1, wherein the wippen has a lever flange portion extending upward a predetermined length and pivotally supporting a repetition lever on which the hammer is placed, by an upper end thereof, and wherein the support portion includes:

a pair of extension portions extending in parallel with each other from the lever flange portion of the wippen toward the jack, and an adjustment screw-engaging portion provided on tip ends of the pair of extension portions and having a screw hole formed therethrough through which the adjustment screw is screwed in a state extending between the pair of extension portions substantially along a direction of a length thereof.

3. The action of a grand piano, according to claim 1, wherein the abutment portion is mounted to the adjustment screw in a state in which the jack-side end of the adjustment screw faces outside, and wherein a portion, with which the abutment portion comes into abutment, of the jack is formed with an operation hole through which a predetermined tool can be inserted from a front side so as to turn the end of the adjustment screw.

4. The action of a grand piano, according to claim 2, wherein the abutment portion is mounted to the adjustment screw in a state in which the jack-side end of the adjustment screw faces outside, and wherein a portion, with which the abutment portion comes into abutment, of the jack is formed with an operation hole through which a predetermined tool can be inserted from a front side so as to turn the end of the adjustment screw.

* * * * *